US008536489B2

(12) United States Patent
Martin et al.

(10) Patent No.: US 8,536,489 B2
(45) Date of Patent: Sep. 17, 2013

(54) HOB AND METHOD FOR PRODUCING A HOB

(75) Inventors: Bernd Martin, St. Georgen (DE); Markus Schlegel, Bretten (DE); Thomas Stein, Taufkirchen/Vils (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 555 days.

(21) Appl. No.: 12/673,620

(22) PCT Filed: Sep. 1, 2008

(86) PCT No.: PCT/EP2008/061513
§ 371 (c)(1),
(2), (4) Date: Feb. 16, 2010

(87) PCT Pub. No.: WO2009/030671
PCT Pub. Date: Mar. 12, 2009

(65) Prior Publication Data

US 2011/0041829 A1 Feb. 24, 2011

(30) Foreign Application Priority Data

Sep. 4, 2007 (DE) ..... 10 2007 041 907

(51) Int. Cl.
*H01B 3/00* (2006.01)

(52) U.S. Cl.
USPC ..... 219/200; 219/255; 219/257; 219/445.1; 219/448.11; 219/452.11

(58) Field of Classification Search
USPC ..... 219/464, 518, 451, 452, 453, 458, 219/465, 463, 50, 68, 77, 105, 107, 121.18, 219/121.22, 121.31, 121.39, 121.83, 200, 219/226, 255, 257, 267, 417, 445.1, 446.1, 219/448.11, 451.1, 452.11, 465.1, 468.2, 219/489, 507, 522
See application file for complete search history.

(56) References Cited

U.S. PATENT DOCUMENTS

| | | | | |
|---|---|---|---|---|
| 174,998 | A * | 3/1876 | Sandin | 2/182.5 |
| 2,889,800 | A * | 6/1959 | Schroeder | 116/310 |
| 4,568,971 | A * | 2/1986 | Alzmann et al. | 348/95 |
| 5,364,820 | A * | 11/1994 | Morimoto et al. | 501/71 |
| 5,432,320 | A * | 7/1995 | Scheidler et al. | 219/445.1 |
| 5,528,015 | A | 6/1996 | von Blanquet et al. | |
| 5,775,319 | A * | 7/1998 | Pettinari | 126/299 R |
| 5,844,206 | A * | 12/1998 | Steiner et al. | 219/452.12 |
| 5,958,272 | A * | 9/1999 | Taplan et al. | 219/445.1 |
| 6,470,879 | B1 * | 10/2002 | Taplan | 126/215 |
| 6,914,223 | B2 | 7/2005 | Krause et al. | |
| 7,763,832 | B2 * | 7/2010 | Striegler et al. | 219/448.11 |

(Continued)

FOREIGN PATENT DOCUMENTS

| | | | |
|---|---|---|---|
| DE | 8701926 | U1 | 4/1987 |
| DE | 3802406 | A1 | 8/1989 |
| DE | 9001807 | U1 | 5/1990 |
| EP | 1465460 | A2 | 10/2004 |

*Primary Examiner* — Cuong Q Nguyen
*Assistant Examiner* — Galina Yushina
(74) *Attorney, Agent, or Firm* — James E. Howard; Andre Pallapies

(57) ABSTRACT

A hob includes a cooking surface with a glass ceramic defining a cutout in an outside edge of the glass ceramic, and an insert in the cutout including a material that is different from the glass ceramic and which is permeable to light in a blue spectral range.

29 Claims, 2 Drawing Sheets

(56) References Cited

U.S. PATENT DOCUMENTS

2003/0183617 A1* 10/2003 Platt ..... 219/452.11
2004/0191531 A1* 9/2004 Melson et al. ..... 428/432
2007/0040990 A1* 2/2007 Chen ..... 353/30
2007/0044788 A1* 3/2007 Jacobs ..... 126/211
2007/0056961 A1 3/2007 Shimatani et al.
2007/0169770 A1* 7/2007 Kuwamura ..... 126/211
2008/0099449 A1 5/2008 England et al.

* cited by examiner

HOB AND METHOD FOR PRODUCING A HOB

BACKGROUND OF THE INVENTION

The invention relates to a hob with a cooking surface made from glass ceramic embodied for positioning a preparation vessel thereon and to a method for producing a hob.

A device for technical control of the operation of the heating elements of cooking areas of cooker hobs is known from DE 87 01 926 U1. The cooker hob comprises a cooking surface with a rectangular glass ceramic plate as well as a display panel strip which is embodied separately from the glass ceramic plate and the front edge of which adjoins the glass ceramic plate. The display panel strip is embodied as transparent and light emitting diodes can be arranged below it. The glass ceramic plate and the display panel strip are surrounded by a frame, with the glass ceramic plate and the display panel strip being able to be sealed in relation to the frame and in relation to each other. The display panel strip thus extends beyond the dimensions of the glass ceramic plate. The arrangement is thus very space-intensive.

Furthermore a cooker with a hotplate is known from DE 103 12 449 A1, which has a hotplate cover plate made of glass ceramic. In addition the hotplate comprises an insert plate which is arranged within the hotplate cover plate and is therefore surrounded by the latter over its entire edge. The insert plate is preferably likewise a glass ceramic plate. It can however be specified with coloring agents, color layers, color pigments or color overlays. A gap embodied between the insert plate and the hotplate cover plate is covered by a decorative frame. This only allows a relatively inadequate attachment and positioning of the components in relation to one another and gives very restricted display options.

In addition a hob with a cooking surface made of glass or glass ceramic is known from DE 196 12 621 C2. At least one function zone which can be made of glass or glass ceramic is let into the cooking surface. This function element is mounted in a cutout of the hob flush with the latter by means of a temperature-resistant, sealed and permanently-elastic connection. The connection can be embodied as an elastic or as a rigid connection and also be a silicon rubber strip for example. The function zone can thus also be glued into the cooking surface. Display elements can be arranged underneath the function zone, with the function zone then serving as a display surface and preferably being embodied from a transparent, non-colored glass or plastic. The arrangement of the function zone within the cooking surface means that this function zone occupies a relatively large amount of space and thus minimizes the possible space for other components or zones of the hob. In addition the display option for this function element or the function zone respectively is greatly restricted in respect to different colorings of the display.

Glass ceramic hobs generally have red displays since commercially-available glass ceramic only lets light in the red spectral range pass through it. Light in the yellow spectral range is corrupted to the extent that it appears to the observer as orange. All other colors are greatly weakened or even completely absorbed, this especially being the case in the blue spectral range and also for white light.

BRIEF SUMMARY OF THE INVENTION

The object of the present invention is to create a hob which can be embodied to minimize the space required to accommodate it and in addition makes it possible to show colors for displaying information more vividly and more flexibly as well as more realistically.

An inventive hob comprises a cooking surface on which one or more preparation vessels are able to be positioned. The cooking surface is also embodied from glass ceramic. The cooking surface includes a cutout made in the glass ceramic on one edge in which a translucent insert is arranged which is embodied from a material which differs from the glass ceramic, which is permeable for light in the blue spectral range. This embodiment of the cooking surface enables a hob with that is very compact in its structure and very space-saving, which in addition is improved in respect of making the display more flexible, especially the presentation of different colors and more than one color and which also guarantees that the colors will be more faithfully displayed.

It is very much in respect of the increasing number of displays and setting options which are to be presented to a user of the hob in a specific and easy-to-understand manner that this design of the hob is able to take better account of such requirements. As well as the quite general specific differentiation by displaying information in a number of colors, the specification with colors of warning displays and the like can be individualized, which enables their visibility for a user to be improved.

Preferably the insert is arranged with its front edge flush with the front edge of the glass ceramic. Thus an especially space-saving design can be created as regards the use of the insert in the cutout. The insert is thus arranged entirely within the dimensions of the cooking surface were the cutout not to be formed and were the cooking surface not to have this cutout available. This means that there is no increase in the surface area. In addition however it can also be guaranteed that by positioning the insert at one edge any further undesired restriction of the surface area of the cooking surface is prevented and thus the dimensions of other zones do not have to be reduced. It is precisely this that is a significant advantage compared to embodiments in which function zones are integrated into the cooking surface such that they are surrounded over almost their entire outer edge by the cooking surface made of glass ceramic. The insert in accordance with the inventive hob is thus also arranged at the optimum position in the hob and is in the optimum position in relation to the cooking surface in this regard.

The fact that the insert is permeable, especially translucent, for light of the blue spectral range, means that it is not glass ceramic.

Preferably the insert is made of gray glass. On the one hand this guarantees that light from the blue spectral range will pass through it, and also light in the red and also yellow spectral range. In addition light colors or other spectral ranges are also allowed through, so that a display area of the hob can be generated by the insert, which allows a plurality of different color representations for different displays and also warning indicators. The individualization of the displays and also the recognizability and the visibility of such a specific display can thus be perceived more intuitively and more easily for the user, especially when a plurality of such displays appear at the same time in the hob.

Preferably in the insert is glued into the cutout of the glass ceramic. It proves especially preferable for the insert to be fixed into the cutout with different adhesives. As well as a stably-positioned arrangement, this enables the production sequence to be optimized and during production the attachment of the relative positioning of the individual components in relation to each other to be securely achieved. Undesired tolerances can be effectively prevented by this method. By using different adhesives, the method also enables the different requirements during the production sequence to be taken into account.

Preferably the insert is fixed in the cutout with a UV (ultraviolet) adhesive and a silicon adhesive. Thus the fixing of the positions of the components in relation to each other can be achieved with the UV adhesive during the production process and in addition the permanent connection can be ensured with the silicon adhesive.

Preferably the UV adhesive is embodied in dots in the gap formed between the insert in the glass ceramic in the cutout and the silicon adhesive can be embodied continuously and therefore as a bead. The amount of adhesive can be minimized or optimized respectively by this embodiment. Merely applying the UV adhesive as dots makes sufficient positioning possible and therefore shortens the production process. A complete filling of the gap in the cutout can preferably be achieved by the silicon adhesive embodied as a bead and thereby an effective and permanently stable connection between the glass ceramic and the insert can be obtained.

Preferably the gap between the insert and the glass ceramic and the adhesive embodied in the gap are covered at the top by a decorative frame.

Contaminations or wear on the adhesive in the gap can be avoided in this way. In addition an impression of high quality can be communicated by this embodiment.

Since the glass ceramic and the insert in particular are tailored to one another such that they appear to a user looking at the hob to be parts of the same material, the interface between the glass ceramic and the insert can also be covered by this decorative frame and this overall optical impression is not spoilt. There is thus almost no difference between the display and/or control area formed by the insert and the cooking surface area formed by the glass ceramic. In addition the clear separation between display and/or control area and cooking surface area can also be created with the decorative frame. The user thus clearly sees where he might hold the hob without being burned. In addition this separation of the surfaces with the decorative frame over the gap between the insert and the glass ceramic can prevent damage to the electronics arranged below the insert, since the user recognizes this decorative frame as the point of separation to the extent that he should not put a hot pan or other preparation vessel on it. Last but not least this decorative frame can prevent the unwanted occurrence of a preparation vessel being shaken from the cooking surface into the display and/or control area.

The fact that the gap between the insert in the glass ceramic is filled with an adhesive, especially a number of different adhesives, enables the thermal conductivity between the glass ceramic and the insert to be at least substantially reduced. Preferably the adhesive is thus also a joint with a low heat conductivity.

Preferably the glass ceramic and the insert arranged in the cutout are positioned in relation to one another so that they are arranged apart from and not in contact with each other and the gap has a width of between 2 mm and 6 mm, especially 4 mm. This dimensioning and arrangement enables the undesired conduction of heat from the glass ceramic or the cooking surface respectively to the insert to be prevented.

Preferably the decorative frame has a width of between 10 mm and 20 mm, especially 15 mm. On the one hand this dimensioning guarantees sufficient coverage of the gap between the glass ceramic and the insert on the one hand and a sufficient mechanical symbolic separation between the cooking surface area and the display and control area on the other hand, which can be recognized quickly and reliably at all times.

Preferably, in the part of its area which covers the top of the gap between the insert and the glass ceramic, the decorative frame has a height of between 0.5 mm and 1 mm, especially 0.7 mm. This makes possible a relatively low-profile decorative frame, which can still be embodied stably however. In this way a weight minimization can be achieved as well as a material saving.

Preferably the insert has on its rear side at least in some areas a black covering permeable for the light in the blue spectral range. This enables the optically identical overall impression between the glass ceramic and the insert to again be improved for the observer. For the user this thus presents an overall picture which imparts an optical impression that both the cooking surface and also the insert are made from the same material, although this is actually not the case however.

Last but not least it can also be guaranteed in this embodiment of the insert that components arranged below it, especially the electronics and/or at least one light source, are covered and are practically invisible from above through the insert. Hiding the light source is to be understood here as its emitted light passing through the insert in the source's activated state, but the light source as such with its design etc. not being visible or being almost undetectable, especially in the deactivated state.

There can be provision for the black coating to be embodied as the film. Likewise however there can be provision for the black coating to be printed on. The film is especially embodied as an adhesive film, with a coating able to be created for example by spraying a material onto this rear side.

Preferably at least one symbol and/or a scale is applied to the rear side of the insert, through which the setting and/or display of settings of a function component of the hob, for example a cooking zone or the like or a selected preparation program can be displayed to the user of the hob. The symbol and/or the scale can also be applied as a film or as an imprint to this rear side. By both the black coating and also a symbol and/or a scale being applied to the rear side of the insert wear caused by rubbing or scratching can be prevented.

Preferably at least one centering element is embodied on the rear side of the insert, which is embodied for relative positioning in relation to a further component of the hob, especially a display unit and/or a light source. Preferably, in the assembled state of the hop, the centering element engages into a corresponding centering recess in the display unit or a circuit board on which the electronics for the display unit and/or a light source are arranged. This embodiment of the insert makes it possible in an especially effective manner to exactly position in the insert relative to the display unit and/or the light source arranged below it. This enables it to be guaranteed securely and exactly that the display or the light emitted from a light source comes through the end third at the desired specific point of the latter and can be recognized by the observer. A symbol and/or a scale are thus backlit at the exact desired position and undesired shadows or light distortions and thereby an image perceived as out of focus can be avoided by this.

Preferably the insert is embodied in the shape of a trapezoid, making a particularly good fit in the cutout. Preferably the cutout is also embodied in the shape of a trapezoid, which gives the cutout and the insert the same shape.

In an inventive method of producing a hob, a glass ceramic of a cooking surface of the hob has a section cut out on one side and is placed into a decorative frame, with an insert permeable for blue light being inserted into the edge cutout which is preferably connected to the glass ceramic with two different adhesives. This embodiment enables a hob occupying minimal space to be provided, in which the positioning of the individual components relative to each other can be exactly fixed and can also be precisely maintained during the production process. Undesired tolerances can be avoided by this.

Preferably there is provision for the insertion of the glass ceramic and of the insert into the decorative frame to occur before the application of the two adhesives and only then for a first adhesive and subsequently a second adhesive to connect the insert to the glass ceramic to be introduced. This method of operation enables a very effective and thereby time-minimized production to be achieved.

There can also be provision for the glass ceramic to initially be glued to the insert and for this complete assembly to be subsequently inserted into the decorative frame.

Preferably the decorative frame is provided with its rear side pointing upwards and the glass ceramic provided with the cutout is inserted with its rear side pointing upwards into the decorative frame, with the insert with its rear side pointing upwards also being inserted in such a manner into the cutout. The production and assembly is thus carried out in practically a reversed position since positioning can be undertaken relatively easily by this method. This stems especially from the fact that the decorative frame is embodied almost in the form of a tray and makes possible the simple and self-retaining insertion of the glass ceramic and of the insert.

In addition this type of method of operation makes it possible for the adhesives subsequently to be introduced very exactly. In particular a UV adhesive is then first introduced which preferably is only introduced in dots into the gap between the insert and the glass ceramic. After the UV adhesive has hardened a silicon adhesive is then introduced into the gap as a continuous bead.

Preferably the top side of the gap between the insert and the glass ceramic filled with adhesive is then covered by a decorative frame.

The hob includes a decorative frame which runs around the outside edge of the glass ceramic and the insert. This can be embodied as a separate frame to the frame that covers the gap between the insert and the glass ceramic in the cutout. Preferably there is provision however for the decorative frame that runs around the outside edge of the glass ceramic and the insert and the decorative frame that covers the gap between the glass ceramic and the insert in the cutout to be embodied in one piece. Here too this can make it possible to attach the components in a simple and tolerance-free manner. In addition the production can be speeded up since two separate decorative frames do not initially have to be exactly positioned relative to one another and then the other components connected to them. Here too undesired tolerances can be avoided in this way.

Advantageous embodiments of the inventive hob are to be seen as advantageous embodiments of the inventive method.

BRIEF DESCRIPTION OF THE DRAWINGS

An exemplary embodiment of the invention is explained below in greater detail with reference to schematic drawings. The figures show.

DETAILED DESCRIPTION OF EXEMPLARY EMBODIMENTS OF THE PRESENT INVENTION

Identical elements or elements with the same functions are provided with the same reference signs in the figures.

Figure 1:
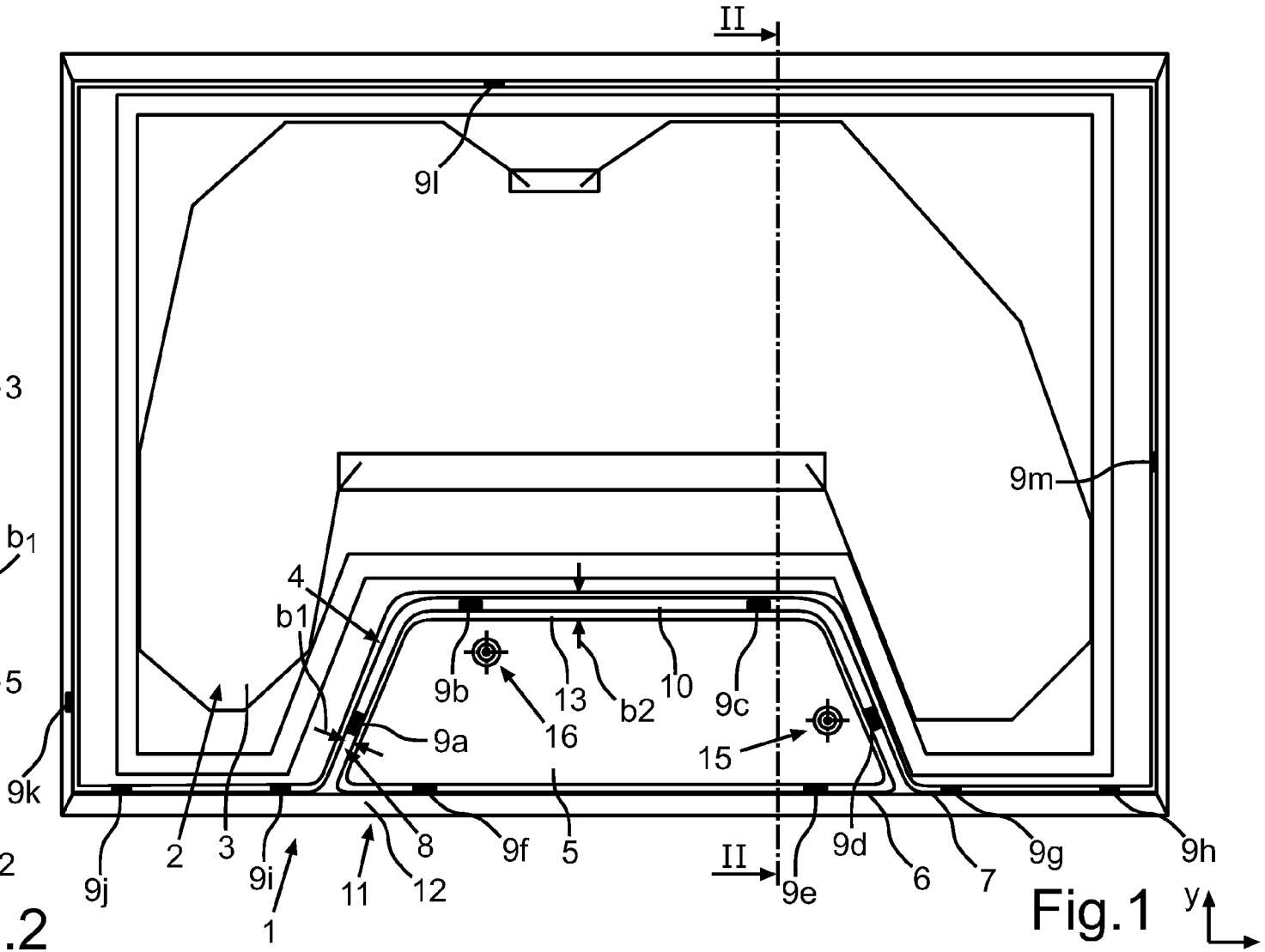
FIG. 1 an overhead view of an inventive hob.

FIG. 1 shows an overhead view of a hob 1 which has a cooking surface 2 made of glass ceramic 3. A food preparation vessel, for example a pot or a pan or the like, can be positioned or placed on this glass ceramic 3. The cooking surface 2 comprises at least one cooking zone not shown in any greater detail, which has a heating device.

On the front edge 7 of the glass ceramic 3 and thus also of the hob 1, a cutout 4 is made on the edge of the hob in the x-direction centrally in the glass ceramic 3. In the assembled state of the hob 1 shown in FIG. 1, an insert 5 is arranged in this cutout 4 which is embodied from a different material compared to the glass ceramic 3. In particular this difference in the material is designed in respect of the different optical properties of the glass ceramic 3 and the insert 5. The cutout 4 and also the insert 5 are embodied in the exemplary embodiment as trapezoidal in shape, with a front edge 6 of the insert 5 being arranged flush with the front edge 7 of the glass ceramic. The insert 5 thus does not extend beyond the front edge 7 of the glass ceramic, which makes for a space-saving design of the hob 1. The fact that the insert 5 is positioned as far out as possible and thereby in the edge-side cutout 4 means that the dimensions of the rest of the cooking surface are not restricted and the functionality, especially also in respect of dimensioning and arrangement of the cooking zones, is thus not adversely affected by the position of the insert 5.

In the exemplary embodiment the insert 5 is embodied from gray glass and one of its characteristics is permeability to light in the blue spectral range. In addition the insert 5 is also permeable to light in the red and yellow spectral range. This embodiment makes it possible to display the widest range of colors, enabling a very wide diversity of settings, control options and indicators to be specified in color. This differentiation feature thus also enables the user of the hob 1 to be provided with a wide diversity of information that can be perceived more quickly and differentiated more easily. Since the material of the glass ceramic 3 absorbs light in the blue spectral range, the insert 5 enables the functionality of the hob and especially of the display and/or control area of the hob 1 to be significantly improved. The display and/or control area of the hob 1 is specified by the insert 5. To this end one or more light sources, especially light emitting diodes, are arranged below the insert 5. Also arranged below the insert 5 is a circuit board which comprises the control electronics.

The insert 5 is arranged at a distance from the glass ceramic 3 and not in contact with the latter in the cutout 4. A gap 8 embodied between the insert 5 and the glass ceramic 3 has a width b1 which amounts to some 4 mm in the exemplary embodiment.

The insert 5 is joined to the glass ceramic 3 in the cutout 4 by two different adhesives. On one hand there is provision for it to be attached by a UV adhesive only embodied as dots, with there being additional provision on the other hand for a silicon adhesive 10. This is embodied as a bead and extends over the entire length of the cutout 4 between the glass ceramic 3 and the insert 5. The UV adhesive is only realized by the adhesion points 9*a*, 9*b*, 9*c* and 9*d*.

In addition this UV adhesive is also intended for attachment of a decorative frame 12 around the circumference of the glass ceramic 3 and the insert 5, with the relevant adhesion points 9*e*, 9*f*, 9*g*, 9*h*, 9*i*, 9*j*, 9*k*, 9*l*1 and 9*m* being indicated here. Both the location of these adhesion points 9*e* to 9*m* and also the number of adhesion points on each of the edges of the surround are merely shown by way of example. Preferably several such adhesion points are embodied on each side on the edges of the surround.

As well as the decorative frame 12 embodied around the circumference, the gap 8 in the cutout 4 is also covered by a decorative frame 13 when viewed from above and thus when seen in the overhead view depicted in FIG. 1. Preferable the decorative frame 12 and the decorative frame 13 are embodied in one piece and form the overall decorative frame 11.

The decorative frame 13 has a width b2 which amounts to 15 mm in the exemplary embodiment.

As well as the decorative frame 11, the hob 1 also includes an installation frame 14 (FIG. 2) which is linked to the decorative frame 11, especially to the decorative surround frame 12. The glass ceramic 3 and the insert 5 is arranged or clamped in and held in a stable position between the decorative frame 11 and the installation frame 14.

Arranged on the rear side of the insert 5 in the exemplary embodiment are two centering elements 15 and 16, which extend downwards in the form of pins. The centering elements 15 and 16 engage in the assembled state of the hob 1 into recesses in the circuit board of the control electronics arranged thereunder, which produces an exact positioning between the insert 5 and the display unit and/or the light sources. This allows the light emitted by the light sources and the display unit to pass through the insert 5 in a very exact manner at the desired specific position and for a position-specific backlighting to be guaranteed.

Figure 2:
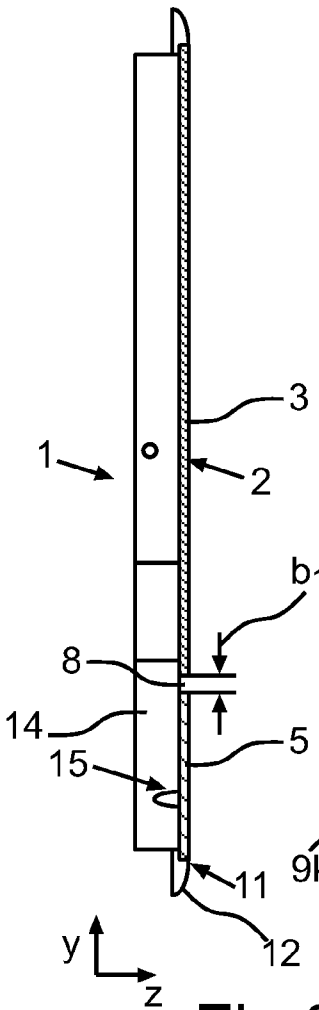
FIG. 2 a sectional diagram of the hob depicted in FIG. 1.

FIG. 2 shows a sectional diagram along the cut line II-II of the hob 1 as depicted in FIG. 1. The centering element 15, extending downwards to a point like the centering element 16, is shown. In the diagram depicted in FIG. 2 the decorative frame 13 over the gap 8 is not shown for the sake of clarity. As can be seen in the diagram according to FIG. 2, the insert 5 has the same thickness (extension in the z-direction) as the glass ceramic 3.

Figure 3:
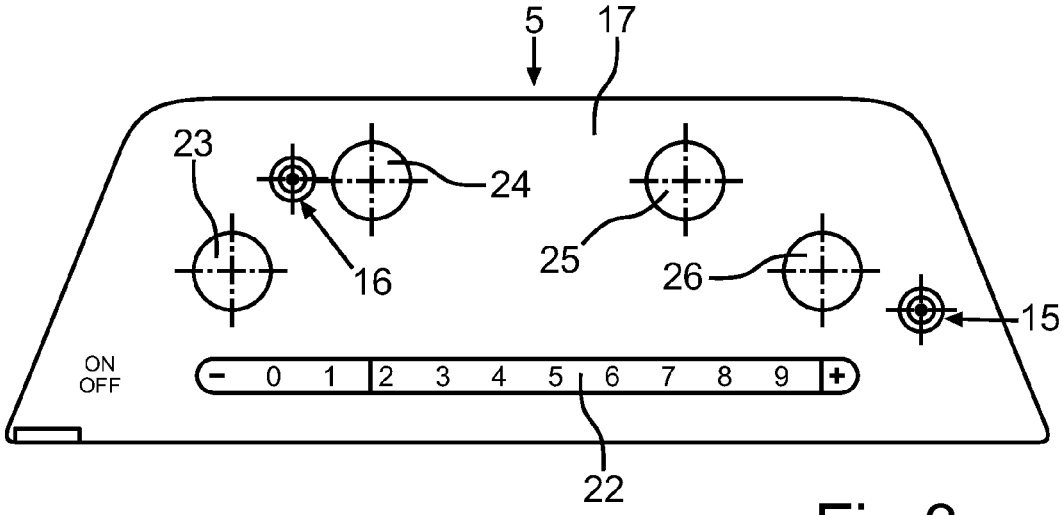
FIG. 3 an enlarged diagram of an overhead view of the insert of the hob depicted in FIG. 1.

FIG. 3 shows a view of the insert 5 from above. A scale 22 and areas 23, 24, 25 and 26 for displaying symbols can be seen on the front side. Both the scale 22 and also the areas 23 through 26 are arranged, especially printed, on a rear side 18 of the insert 5 shown in FIG. 4. The scale 22 and the areas 23 through 26 are printed on in a white color which, when viewed from the other side, because of the embodiment of the insert 5 as gray glass, no longer appears pure white, but in a gray tone. In addition the permeability of the light in the blue spectral range is not adversely affected by the scale 22 and the areas 23 through 26.

Figure 4:
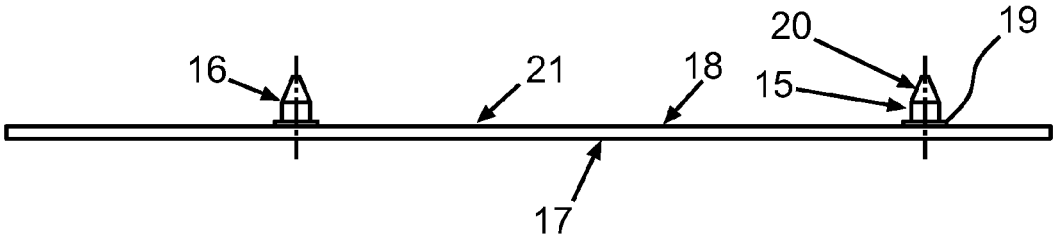
FIG. 4 a side view of the insert as depicted in FIG. 3.

FIG. 4 shows the side view of the insert 5 as depicted in the diagram in FIG. 3. On the rear side 18, as well as the printing with the scale 22 and the areas 23 through 26, a black coating 21 is applied to the remainder of the surface which can be realized as a foil or especially as an imprint. This coating 21 does not adversely affect the permeability of the light in the blue spectral range.

The centering element 15 has an adhesion point 19 which makes it possible to attach it to corresponding components of the hob 1. In addition the tip 20 of the centering element 15 engages in the already-mentioned recess in the printed circuit board arranged below the insert 5. The centering element 16 is embodied in a similar manner.

To produce the hob 1 in accordance with the diagram shown in FIG. 1, the decorative frames 12, 13 are first turned over and the upper side thus lies facing downwards on an installation device. The glass ceramic 3 already provided with the cutout 4 is then likewise turned over and, with its upper side shown in FIG. 1 pointing downwards, is inserted into these decorative frames 12, 13. The procedure is the same for the insertion of the insert 5 into the decorative frames 12, 13, so that here too the upper side or front side 17 is arranged pointing downwards. In a subsequent production step dots of UV adhesive are then applied, as is shown by way of example, at the corresponding adhesion points 9*a* through 9*m*. In particular a number of adhesion points per side are realized on each side of the surround. After the UV adhesive has dried the silicon adhesive 10 is then applied as a bead in the gap 8. The imprinting of the insert 5 on the rear side 18 with the areas 23 through 26, the scale 22 and the black coating 21 is carried out before the insertion of the insert 5 into the turned-over decorative frames 12, 13. The insert 5 is joined to the decorative frames 12, 13 and to the glass ceramic 3 by the UV adhesive and the silicon adhesive 10.

Subsequently the installation frame 14 is then also assembled. Further or preceding method steps of subordinate importance for the invention and will not be described in any greater detail here since they essentially represent known method steps.

It should additionally be mentioned that the join between the insert 5 and the glass ceramic 3 can also be realized in another way. The adhesive joint can thus also be replaced by a another type of joint or if necessary also be enhanced.

The invention claimed is:

1. A hob comprising:

a cooking surface comprising a glass ceramic and defining a cutout in an outside edge of the glass ceramic; and an insert in the cutout comprising a material that is different from the glass ceramic and which is permeable to light in a blue spectral range, wherein an outside edge of the insert is partially bordered by the outside edge of the glass ceramic.

2. The hob of claim 1, wherein a front edge of the insert is flush with a front edge of the glass ceramic.

3. The hob of claim 1, wherein the insert comprises gray glass.

4. The hob of claim 1, further comprising a symbol or a scale on a rear side of the insert.

5. The hob of claim 1, further comprising a centering element on a rear side of the insert for positioning of a display or a light source.

6. The hob of claim 1, wherein the insert is trapezoid shaped.

7. The hob of claim 1, wherein the insert is glued into the cutout.

8. The hob of claim 7, wherein the insert is attached with different adhesives in the cutout.

9. The hob of claim 7, wherein the insert is attached with a UV adhesive and a silicon adhesive in the cutout.

10. The hob of claim 8, wherein the insert and the glass ceramic in the cutout defines a gap that includes dots of the UV adhesive and a contiguous bead of the silicon adhesive.

11. The hob of claim 1, wherein the insert and the glass ceramic in the cutout defines a gap with a width of between 2 mm and 6 mm.

12. The hob of claim 11, wherein the gap has a width of about 4 mm.

13. The hob of claim 1, further comprising a decorative frame covering a top of a gap defined by the insert and the glass ceramic in the cutout.

14. The hob of claim 13, wherein the decorative frame has a width of between 10 mm and 20 mm.

15. The hob of claim 14, wherein the decorative frame has a width of about 15 mm.

16. The hob of claim 13, wherein the decorative frame has a height of between 0.5 mm and 1 mm.

17. The hob of claim 16, wherein the decorative frame has a height of 0.7 mm.

18. The hob of claim 1, wherein the insert has a coating that is permeable to light in the blue spectral range.

19. The hob of claim 18, wherein the coating is on a rear side of the insert.

20. The hob of claim 18, wherein the coating comprises a film.

21. The hob of claim 18, wherein the coating comprises an imprint.

22. A method for producing a hob comprising:

cutting out one edge of a glass ceramic of a cooking surface to form an edge cutout;

inserting the glass ceramic into a decorative frame;

inserting an insert that comprises a material that differs from a material of the glass ceramic and that is permeable to light in a blue spectral range into the edge cutout; and joining the insert to the glass ceramic with two different adhesives.

23. The method of claim 22, wherein a rear side to the decorative frame points upwards, and wherein inserting the glass ceramic into the decorative frame comprises inserting the glass ceramic into the decorative frame with a rear side of the glass ceramic pointing upwards and wherein inserting the insert comprises inserting the insert with a rear side of the insert pointing upwards.

24. The method of claim 22, further comprising providing an adhesive in a gap between the insert and the glass ceramic and wherein the decorative frame covers the gap.

25. The method of claim 22, wherein the joining of the insert to the glass ceramic comprises introducing dots of UV adhesive into a gap between the insert and the glass ceramic.

26. The method of claim 25, further comprising inserting a silicon adhesive into the gap as a contiguous bead after the UV adhesive has hardened.

27. A hob comprising:

a cooking surface comprising a glass ceramic and defining a cutout in an outside edge of the glass ceramic; and an insert in the cutout comprising a material that is different from the glass ceramic and which is permeable to light in a blue spectral range, and a centering element on a rear side of the insert for positioning of a display or a light source wherein the centering element includes a projecting member on a rear side of the insert for operational contact with an underlying structure.

28. The hob of claim 27, wherein the centering element is a conical member projecting from a rear side of the insert.

29. A hob comprising:

a cooking surface comprising a glass ceramic and defining a cutout in an outside edge of the glass ceramic; and an insert in the cutout comprising a material that is different from the glass ceramic and which is permeable to light in a blue spectral range, wherein the insert is attached with different adhesives in the cutout.

* * * * *

UNITED STATES PATENT AND TRADEMARK OFFICE

CERTIFICATE OF CORRECTION

PATENT NO. : 8,536,489 B2
APPLICATION NO. : 12/673620
DATED : September 17, 2013
INVENTOR(S) : Martin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 644 days.

Signed and Sealed this
Fifteenth Day of September, 2015

Michelle K. Lee

Michelle K. Lee
*Director of the United States Patent and Trademark Office*